US005803949A

United States Patent [19]

Brown et al.

[11] Patent Number: 5,803,949

[45] Date of Patent: Sep. 8, 1998

[54] FLUIDIZED BED ROASTING PROCESS

[75] Inventors: Murray J. Brown, Rossland; David W. Goosen, Castlegar, both of Canada

[73] Assignee: Cominco Ltd., Vancouver, Canada

[21] Appl. No.: 641,006

[22] Filed: Apr. 29, 1996

[51] Int. Cl.[6] ..... C22B 5/00

[52] U.S. Cl. ..... 75/751; 75/746; 75/770; 75/754; 148/514

[58] Field of Search ..... 75/751, 746, 770, 75/754; 148/514

[56] References Cited

U.S. PATENT DOCUMENTS

| | | | |
|---|---|---|---|
| 2,779,671 | 1/1957 | Fassotte | 75/3 |
| 4,367,153 | 1/1983 | Seiver et al. | 252/62.55 |
| 5,460,765 | 10/1995 | Derdall et al. | 264/117 |

FOREIGN PATENT DOCUMENTS

| | | |
|---|---|---|
| B79724/87 | 6/1990 | Australia . |
| 975966 | 10/1975 | Canada . |
| 809765 | 3/1956 | United Kingdom . |

OTHER PUBLICATIONS

1. Article entitled "The Use of Additives in the Pellitizing Process" from publication entitled Agglomeration of Iron Ores, by D.F. Ball et al; published by American Elsevoir Publishing Company, New York, 1973.

2. Article entitled "Sherbrooke's new roasting technique" by Stanley H. Dayton; Metal Mining and Processing, Jan./64; pp. 38–42.

3. Paper entitled "Metallurgie Hoboken–Overpelt Process For Roasting Zinc Concentrates In a Fluid Bed" by R. Denoiseux et al, 1980.

*Primary Examiner*—David A. Simmons
*Assistant Examiner*—M. Alexandra Elve
*Attorney, Agent, or Firm*—Elbie R. de Kock

[57] ABSTRACT

A method of stabilizing a fluidized bed in a fluidized bed roasting process for metal sulphide concentrate comprises the step of controlling the particle size distribution of the particulate material in the bed so that a minimum amount of no less than about 30% of the concentrate falls in a size range of from about 100 to about 420 microns. The minimum amount preferably falls in the range of from about 35% to about 40%. In one embodiment of the invention the particle size distribution is controlled by maintaining the amount of lead in the concentrate in a range from about 3% to about 4%, preferably 3.7% to about 3.8%. In another embodiment the particle size distribution is controlled by using a pelletized feed or by the combination of the steps of using a pelletized feed and regulating the lead content of the concentrate.

27 Claims, 1 Drawing Sheet

FLUIDIZED BED ROASTING PROCESS

FIELD OF THE INVENTION

This invention relates to a fluidized bed roasting process for metal sulphide concentrates, such as zinc sulphide concentrate, or a blend of such concentrates, and in particular, a method of stabilizing the roaster bed and reducing carryover by inducing and controlling the size distribution of the bed.

BACKGROUND OF THE INVENTION

Even though certain commercially available roasters, such as the Lurgi™ fluidized bed roasters, are designed to handle a high solids loading in the gas stream, the fineness of some concentrates has been identified as a significant contributor to low on-line operating times, and the resulting decrease in zinc production. Fine materials have a higher tendency to leave the roaster bed with the fluidizing combustion gases, and as a consequence, a greater percentage of the concentrate will react in the roaster freeboard. This increases the boiler inlet temperature and results in the formation of sticky calcine which can foul the boiler tubes and cyclones. The fine-sized solids in the gas stream are also carried further along the gas handling system. Though these solids are finally removed at the electrostatic precipitators and scrubbers, the higher solids loading increases the maintenance frequency and the workload on these units.

Improving the fluidising properties of a fluidized bed roaster has been attempted. For example, Australian Patent No. 604,062 (AU-B-79724/87) describes a process for improving fluidizing properties of materials in the bed of a fluidized-bed roaster by increasing the proportion of material of an intermediate size range in the feed to the bed.

In the extractive metallurgical industry, pelletization of concentrate is known. The iron ore industry has pelletized taconite-type iron ore feeding the blast furnaces since the 1950's. The problem, however, is whether pellets made with fine metal sulphide concentrates, such as zinc sulphide concentrate, can be made strong enough to withstand handling and roasting in a fluidized bed roaster.

SUMMARY OF THE INVENTION

According to the invention there is provided a method of stabilizing a fluidized bed in a fluidized bed roasting process for metal sulphide concentrate, comprising the step of controlling the particle size distribution of the particulate material in the bed so that a minimum amount of no less than about 30% of the material falls in a size range of from about 100 to about 420 microns. The minimum amount is preferably no less than about 35%. Preferably, the minimum amount falls within the range of from about 35% to about 40%.

The controlling of the particle size distribution may comprise maintaining an amount of agglomerating agent in a concentrate feed to the bed to produce said particle size distribution in the bed. The agglomerating agent may comprise a metal sulphide, such as PbS, $FeS_2$ or FeS, which is present in the concentrate.

The controlling of the particle size distribution may also comprise maintaining an amount of lead in the concentrate in a range of from about 3% to about 4% by weight of the concentrate. The amount of lead is preferably from about 3.7% to about 3.8% by weight of the concentrate.

The controlling of the particle size distribution may also comprise feeding concentrate to the bed which has been subjected to pelletization to increase the particle size thereof. The controlling of the particle size distribution may comprise either controlling the lead content of the concentrate or using a pelletized feed, or both of these methods in combination.

Also according to the invention there is provided a pelletization process comprising the steps of mixing a predetermined amount of a fine metal sulphide concentrate with a predetermined amount of a liquid binder to achieve a resulting mixture with a moisture content of less than 11.5% by weight, wherein said mixing is effected in a batch-wise fashion for a predetermined period of time with a high shear mixer and wherein the moisture content of the resultant mixture is adjusted to produce pellets within a size range of from about 100 microns to about 3300 microns during said mixing. The moisture content is preferably adjusted to produce pellets, a proportion of which falls within a size range of from about 100 microns to about 1000 microns, and preferably, from about 100 microns to about 420 microns.

In this specification, a high shear mixer, refers to a mixer which provides intensive mixing action and homogenization of the feed materials. This would generally be achieved by specific mixer design characteristics that could include proprietary geometrical parameters, deflectors, rotors, high speed motors and the like. Applicant has found that the commercially available Eirich™ Type R Intensive Mixer is one such suitable device.

The liquid binder may comprise water or an aqueous sulphate solution. Preferably, the liquid binder comprises a zinc sulphate solution.

The process may further comprise the step of mixing a solid binder with the metal sulphate concentrate and the liquid binder.

In one embodiment of the invention the amount of solid binder is from 0.5% to about 3%, preferably from about 1% to about 2%, by weight of the amount of concentrate. In another embodiment, the amount of solid binder is no more than about 1% by weight of the amount of concentrate.

The solid binder may comprise a material which is internal to a fluidized bed roasting process, such as effluent treatment plant (ETP) residue or cyclone/electrostatic precipitator (ESP) catch.

Further objects and advantages of the invention will become apparent from the description of a preferred embodiment of the invention below.

DETAILED DESCRIPTION OF PREFERRED EMBODIMENT

In carrying out the roasting process according to the invention, a Lurgi™ turbulent bed roaster, with a bed area of $84m^2$ was used. This type of roaster is well known in the industry, particularly with respect to the roasting of zinc concentrates. Accordingly, the roaster will not be described in any further detail herein.

For the sake of comparison, typical operating conditions that exist with an unstable fluidized bed, using a fine zinc sulphide concentrate, are as follows: Fluidized bed size distribution:

| Fluidized bed size distribution: | | |
|---|---|---|
| Fine (<105 microns) | >50% | |
| Intermediate (105–420 microns) | 5–15% | |
| Coarse (420–1100 microns) | — | |
| Very Coarse (>1100 microns) | >35% | |
| Bed Overflow | 5–15% | of calcine produced |
| Dust Load to ESP | 4–6% | of calcine produced (12–18 gms/m$^3$) |
| Boiler Outlet Temperature | 450–500 | deg. C. (fouling) |
| Windbox pressure | 2100–2200 | mm$H_2O$ |

In carrying out the method according to one aspect of the invention, using a fine zinc sulphide concentrate, feed to the roaster is assayed and controlled so that the lead content thereof is maintained at about 3.7 to 3.8% of Pb by weight of the concentrate. However, a broader range of from about 3% up to a maximum of 4% can be tolerated. From the known assays of concentrate, the make up of the feed to the bed can be controlled, e.g. by a combination or blending of different concentrates, to produce a resulting feed to the bed containing the desired amount of agglomerating agent.

Any shortfall of lead in the zinc concentrate making up the roaster mix can be supplemented with the addition of lead concentrate, if necessary.

Figure 1:
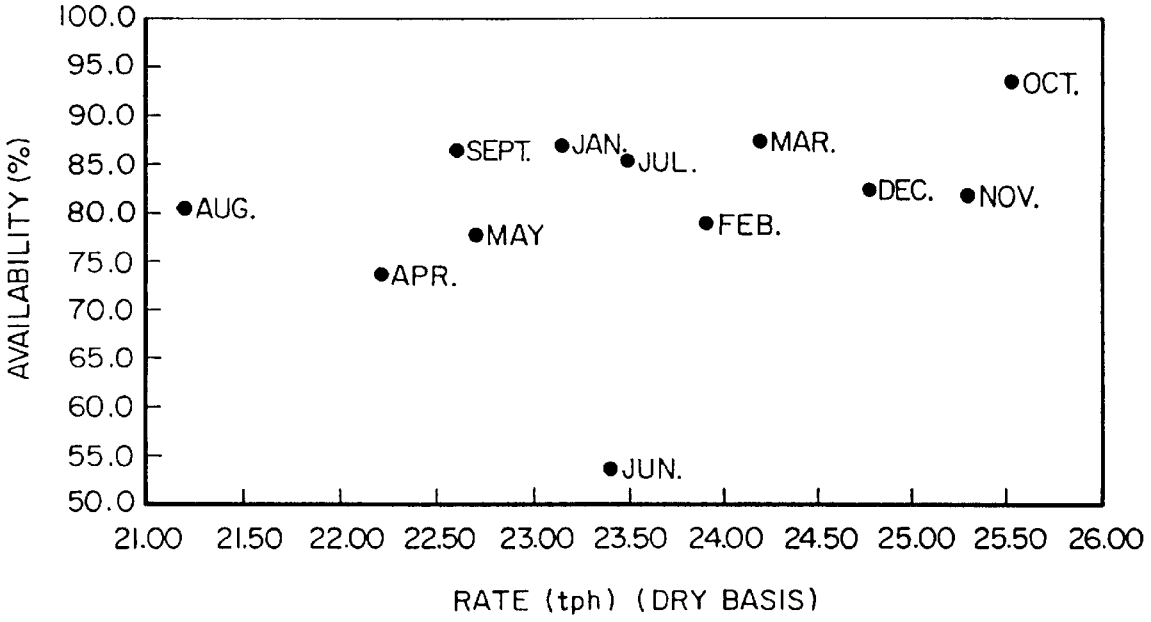
FIG. 1 is a graph of availability and rates of a roaster operating over a 12 month period under unstable conditions.
Figure 2:
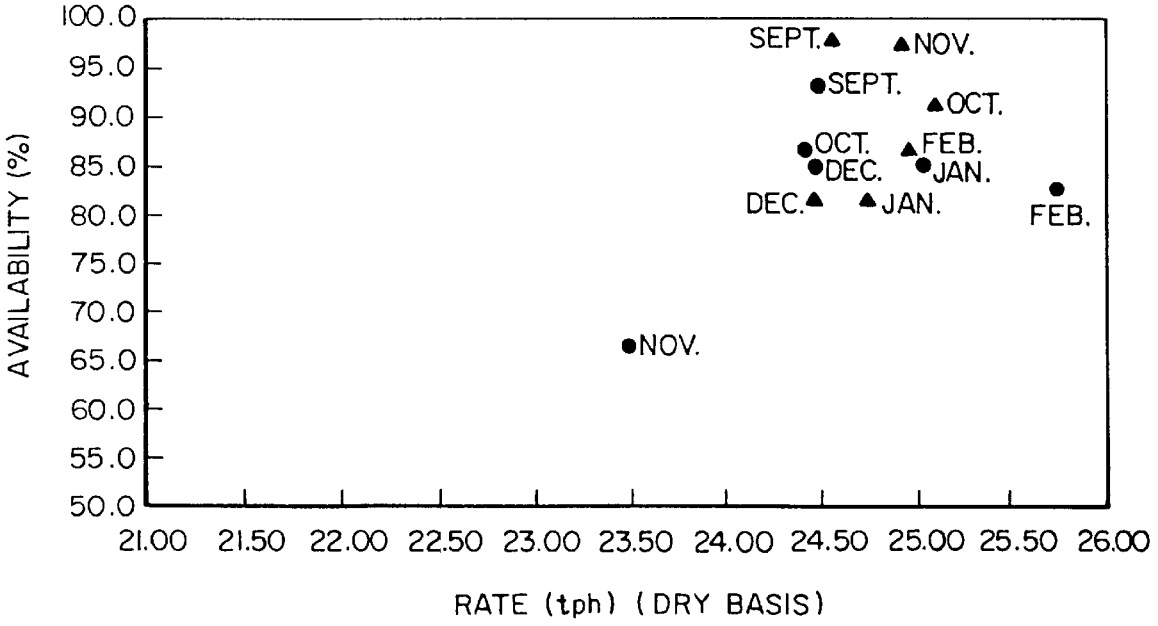
FIG. 2 is a graph of the same paramaters in respect of two roasters operating over a 6 month period during which the lead content was controlled according to the method of the invention.

This feed strategy has resulted in less day-to-day variation of the intermediate size fraction in the feed and much more stable roaster operation. With this method, there has been a marked improvement in roaster rate and availability as illustrated by FIGS. 1 and 2, respectively.

Roaster "availability" refers to the time the roaster is operated expressed as a percentage of the time that the roaster is available for operation. The term "rate" refers to the feed rate of material to the roaster, expressed as metric tonnes per hour.

The results obtained are as follows:

| Fluidized bed size distribution: | | |
|---|---|---|
| Fine (<105 microns) | 15–25% | |
| Intermediate (105–420 microns) | >30% | |
| Coarse (420–1100 microns) | — | |
| Very Coarse (>1100 microns) | 15–30% | |
| Bed Overflow | 25–35% | of calcine produced |
| Dust Load to ESP | 2–3% | of calcine produced (4–8 gms/m$^3$) |
| Boiler Outlet Temperature | <425 | deg. C. (significantly less fouling) |
| Windbox pressure | 2500–2800 | mm$H_2O$ |

It can be seen that no less than 30% of the roaster bed material falls in a size range of from 100 to 420 microns, compared with 5 to 15% under unstable conditions. The bed overflow is increased to 25 to 35% of calcine produced, compared with 5 to 15% under unstable conditions. In addition the dust load to the electrostatic precipitator is reduced and the boiler outlet temperature has also dropped significantly. The windbox pressure has increased to 2500 to 2800 mm $H_2O$ from 2100 to 2200 mmHg $H_2O$.

A pelletization process according to the invention will now be described by way of an example.

An accurately weighed amount, e.g. by way of a weigh feeder, of fine zinc sulphide concentrate, or a blend of two or more different zinc sulphide concentrates, is accumulated in a holding bin. In the present example, the amount is 3800 kg. The 3800 kg batch is then fed, over a 30 second period to a constantly mixing Eirich™ mixer.

Binder material in the form of cyclone/ESP catch, in the present example, at typically 1–2% by weight of the concentrate, is also fed to the Eirich™ mixer simultaneously with the concentrates, over the 30 second period.

Liquid phase, typically an aqueous zinc sulphate solution, is fed to the mixer after the solid materials have been added to the mixer. Sufficient liquid phase is added to produce a moisture content of about 11% for the concentrate being used. For example, the concentrate used in this example already contained some moisture.

The material is continuously mixed in batch mode for a total time of about 5 minutes, measured from the start of the addition of the concentrate to the mixer. The material is then discharged and a new mixing cycle is commenced. The process is carried out at ambient temperature and no heating is required.

The process produces pellets with a size range from about 200–3300 microns, with an average size of about 1500 microns. With a lower moisture content, particulates with sizes down to 100 micron can be produced. The moisture content determines the size distribution of the agglomerates. Thus, the particle size distribution can be controlled by adjusting the moisture content. However, a moisture content of more than about 11.5% is to be avoided since above this value undesirable globs are formed.

A variety of materials can be used as binders. A sulphate containing solution, e.g. a solution which is internal to the zinc production process, such as clarifier overflow (COF) or neutral feed (NF) both of which contain zinc sulphate, when used alone as a binder, i.e. without the addition of a solid binder, was more effective than water used alone as a binder. Such solutions typically contain about 150 g/l zinc as zinc sulphate. An essentially neutral solution (pH 5.0) of 150 g/l zinc sulphate is preferred but other suitable solutions can be used.

It has been found that solid binders and a sulphate solution result in better performance than just a sulphate containing solution alone. The addition of a solid binder provides for a higher capacity for liquid phase binder addition, and as a result, yields higher strength pellets. Preferably a sulphate containing material is selected.

For economic reasons, desirable solid binders are selected from materials which are internal to the zinc production process. The following have been found to be useful:

Effluent treatment plant (ETP) residue. Usefulness as a binder has been demonstrated and, as such, it can be satisfactorily recycled to the roasters (carry-over to the gas stream is minimized). The material is an endothermic load in roasting, thereby providing roaster bed cooling.

Cyclone/ESP catch. This material has been found to be particularly useful as a binder.

Roaster calcine. This roaster product material has also been found to be useful.

Bentonite. This has been found satisfactory, but is not desirable, as it introduces superfluous material. Testwork has indicated that bentonite can generally be eliminated in the present process.

Quicklime. This material has also been found to be satisfactory, but, again is not desirable, as it introduces superfluous material.

The amount of solid binder used is typically from about 0.5% to about 3.0% by weight of the concentrate. Preferably, the amount ranges from 0 to about 1%, based on the desire to minimize solids handling and recycle, but if ETP residue is used, it is desirable to recycle larger quantities. Table 1 gives some examples:

TABLE 1

Ranking of Binding Agents in order of effectiveness

| Ranking | Pellet Type |
|---|---|
| 1 | 1% bentonite, 1% ESP, COF |
| 2 | 3% $ZnSO_4$, COF |
| 3 | 1% bentonite, 2% ESP, NF |
| 4 | 1% lime, 1% calcine, COF |
| 5 | 1% "Red Dog" sludge, 1% bentonite, COF |
| 6 | 0.5% bentonite, 1% calcine, COF |
| 7 | 0.1% bentonite, 1% calcine, COF |
| 8 | 1% bentonite, 1% calcine, COF |
| 9 | 1% ETP sludge, COF |

In the above table, "Red Dog" sludge refers to sludge from applicant's Red Dog mine in Alaska.

The typical cyclone/ESP catch which is suitable for use as a solid binder is a variable blend of dusts captured from the fluidized bed roaster off-gas. The dusts are collected in cyclones and electrostatic precipitators. An approximate analysis is shown in Table 2.

TABLE 2

Analysis of Cyclone/ESP catch

| | $SO_4$/S % | Zn % |
|---|---|---|
| ESP | 3.8–6.6 | 48–55 |
| Cyclone | 2.4–3.8 | 52–58 |

It is believed that the sulphate content assists the binding process and that material higher in sulphate content, such as ESP catch, is beneficial.

The retention time in the batch pelletization process may be from about 1 to 30 minutes, preferably 5 to 10 minutes and, typically, a retention time of at least 5 minutes is preferred.

It has been found that the pelletized material can be stored for an indefinite period before roasting. Storage temperatures can vary. The storage temperature can be below freezing point. It has also been found that pellet compressive strength does not change with the number of freeze/thaw cycles.

In carrying out the method according to another aspect of the invention, pelletized concentrate is included in the feed to the roaster to maintain the desired particle size distribution of particulate material in the bed. While this method can be used as an alternative to controlling the amount of agglomerating agent in the concentrate, it can also be carried out in conjunction with control of the agglomerating agent, depending on the type of concentrate used.

While only preferred embodiments of the invention have been described herein in detail, the invention is not limited thereby and modifications can be made within the scope of the attached claims.

What is claimed is:

1. A method of stabilizing a fluidized bed in a fluidized bed roasting process for metal sulphide concentrate, comprising the step of controlling the particle size distribution of particulate material in the bed so that a minimum amount of no less than about 30% of the material falls in a size range of from about 100 to about 420 microns.

2. The method according to claim 1, wherein said minimum amount is no less than about 35%.

3. The method according to claim 2, wherein said minimum amount falls within the range of from about 35% to about 40%.

4. The method according to claim 1, wherein said controlling of the particle size distribution comprises maintaining an amount of agglomerating agent in a concentrate feed to the bed to produce said particle size distribution in the bed.

5. The method according to claim 4, wherein the agglomerating agent comprises a metal sulphide present in said concentrate feed to the bed.

6. The method according to claim 1, wherein said controlling of the particle size distribution comprises maintaining an amount of lead in a concentrate feed to the bed in a range of from about 3% to about 4% by weight of the concentrate.

7. The method according to claim 6, wherein the amount of lead is from about 3.7% to about 3.8% by weight of the concentrate.

8. The method according to claim 1, wherein said controlling of the particle size distribution comprises feeding concentrate to said bed which has been subjected to pelletization to increase the particle size thereof.

9. The method according to claim 8, wherein said pelletization comprises mixing a predetermined amount of a fine metal sulphide concentrate with a predetermined amount of a liquid binder to achieve a resulting mixture with a moisture content of less than 11.5% by weight, wherein said mixing is effected in a batch-wise fashion for a predetermined period of time with a high shear mixer and wherein the moisture content of the resultant mixture is adjusted to produce pellets within a size range of from about 100 microns to about 3300 microns during said mixing.

10. The method according to claim 9, wherein the moisture content is adjusted to produce pellets a proportion of which is within a size range of from about 100 microns to about 1000 microns.

11. The method according to claim 10, wherein the moisture content is adjusted to produce pellets a proportion of which is within a size range of from about 100 microns to about 420 microns.

12. The method according to claim 9, wherein said liquid binder comprises water.

13. The method according to claim 9, wherein said liquid binder comprises an aqueous sulphate solution.

14. The method according to claim 13, wherein said sulphate solution is a zinc sulphate solution.

15. The method according to claim 9, further comprising the step of mixing a solid binder with said metal sulphide concentrate and said liquid binder.

16. The method according to claim 15, wherein the amount of said solid binder is from about 0.5% to about 3% by weight of the amount of concentrate.

17. The method according to claim 16, wherein the amount of said solid binder is from about 1% to about 2% by weight of the amount of concentrate.

18. The method according to claim 15, wherein the amount of solid binder is no more than about 1% by weight of the amount of concentrate.

19. The method according to claim 15, wherein the solid binder comprises effluent treatment plant residue.

20. The method according to claim 15, wherein the solid binder comprises cyclone/ESP catch.

21. The method according to claim 15, wherein said solid binder comprises calcine.

22. The method according to claim 15, wherein said solid binder comprises a sulphate compound.

23. The method according to claim 9, wherein said predetermined period of time is from about 1 to about 30 minutes.

24. The method according to claim 23, wherein said predetermined period of time is from about 5 to about 10 minutes.

25. The method according to claim 9, wherein the moisture content is adjusted to produce pellets a proportion of which is within a size range of from about 100 microns to about 1000 microns.

26. The method according to claim 25, wherein the moisture content is adjusted to produce pellets a proportion of which is within a size range of from about 100 microns to about 420 microns.

27. The method according to claim 1, wherein said controlling of the particle size distribution comprises feeding concentrate to said bed which has been subjected to pelletization to increase the particle size thereof and maintaining a predetermined amount of lead in said concentrate.

* * * * *